US007004494B2

(12) United States Patent
Wulf et al.

(10) Patent No.: US 7,004,494 B2
(45) Date of Patent: Feb. 28, 2006

(54) SKI BOOT AND SKI BOOT BINDING

(76) Inventors: Elmer B. Wulf, 2809 Gupsum Cir., Naperville, IL (US) 60564; Mark E. Wulf, 2447 Boulevard de John, Naperville, IL (US) 60564

( * ) Notice: Subject to any disclaimer, the term of this patent is extended or adjusted under 35 U.S.C. 154(b) by 242 days.

(21) Appl. No.: 10/249,961

(22) Filed: May 22, 2003

(65) Prior Publication Data

US 2003/0218315 A1 Nov. 27, 2003

Related U.S. Application Data

(60) Provisional application No. 60/382,499, filed on May 22, 2002.

(51) Int. Cl.
*A63C 9/086* (2006.01)

(52) U.S. Cl. ..... 280/616; 280/634; 280/623

(58) Field of Classification Search ..... 280/611, 280/613, 614, 623, 624, 634, 636, 616, 617
See application file for complete search history.

(56) References Cited

U.S. PATENT DOCUMENTS

| | | | | | |
|---|---|---|---|---|---|
| 3,689,096 | A | * | 9/1972 | Ribi | 280/613 |
| 3,822,070 | A | * | 7/1974 | Salomon | 280/637 |
| 3,936,062 | A | * | 2/1976 | Schweizer | 280/613 |
| 4,060,256 | A | * | 11/1977 | Collombin et al. | 280/613 |
| 4,079,961 | A | * | 3/1978 | Vaudaux | 280/613 |
| 4,288,094 | A | * | 9/1981 | Svoboda | 280/623 |
| 4,418,937 | A | * | 12/1983 | Salomon | 280/613 |
| 4,728,115 | A | * | 3/1988 | Pozzobon et al. | 280/613 |
| 4,732,405 | A | * | 3/1988 | Freisinger et al. | 280/634 |
| 4,880,251 | A | | 11/1989 | Wulf et al. | 280/613 |
| 4,889,358 | A | * | 12/1989 | Rullier | 280/628 |
| 5,020,822 | A | | 6/1991 | Wulf et al. | 280/613 |
| 5,026,087 | A | | 6/1991 | Wulf et al. | 280/613 |
| 5,107,608 | A | | 4/1992 | Kreitenberg | 36/117 |
| 5,412,883 | A | * | 5/1995 | Wulf et al. | 36/50.5 |
| 6,131,313 | A | | 10/2000 | Pierce et al. | 36/118.3 |
| 6,769,711 | B1 | * | 8/2004 | Martin et al. | 280/625 |
| 2002/0105168 | A1 | * | 8/2002 | Lancon | 280/625 |

* cited by examiner

*Primary Examiner*—Jeff Restifo
(74) *Attorney, Agent, or Firm*—Hartman & Hartman; Gary M. Hartman; Domenica N. S. Hartman

(57) ABSTRACT

Ski equipment that provides, preferably in combination, a toe release system for reducing the risk of knee injuries and a steering system for increasing turn performance. In the toe release system, the binding has a toe binding portion secured with a securing element at a forward position relative to a rear binding portion of the binding, and a release element that communicates with the securing element for releasing the toe binding portion in response to the application of pressure to the rear cuff of a boot secured with the binding, permitting movement of the toe binding portion away from the rear binding portion and thereby releasing a toe of the boot. In the steering system, the boot includes a tracking assembly that permits controlled flexing of the front and rear cuffs of the boot by applying forward and lateral pressure to the front cuff.

30 Claims, 3 Drawing Sheets

SKI BOOT AND SKI BOOT BINDING

CROSS REFERENCE TO RELATED APPLICATIONS

This application claims the benefit of U.S. Provisional No. 60/382,499, filed May 22, 2002.

BACKGROUND OF INVENTION

1. Field of the Invention

The present invention generally relates to ski equipment. More particularly, this invention relates to a ski boot and ski boot binding system that provides, preferably in combination, a toe release system for reducing the risk of knee injuries and an ankle-flex steering system for increasing turn performance.

2. Description of the Related Art

The stiffness of modern ski boots has drastically reduced the incidence of ankle injuries. For ski boots of the clam shell-type (having front and rear cuffs pivotably coupled to a foot shell), this stiffness is the result of permitting only limited lean adjustment in the forward direction and essentially none in the rearward direction. While protecting the ankle, boot stiffness places greater loads on the knee, such that sprains and tears of the anterior cruciate ligament (ACL) are now a relatively common type of injury associated with downhill skiing. One particular type of ACL injury is termed the "phantom foot injury" and involves the tail of the ski, which points in the opposite direction of the skiers" foot. A phantom foot injury occurs when the tail of the ski acts as a lever to apply (through the rigid rear cuff of the boot mounted to the ski) a forward force on the lower leg. Such a situation occurs when the skier is off-balance rearward, with hips below the knees in a squatting position. In this position, the lack of flexing of the boot rear cuff results in the tail of the ski being forced downward. The tendency is for an edge of the ski tail to "catch," causing the ski and boot, and therefore the lower leg of the skier, to twist under load.

Various approaches have been proposed for avoiding this type of injury, notable examples of which include commonly-owned U.S. Pat. Nos. 4,880,251, 5,020,822, 5,026,087, and 5,412,883. The avoidance of phantom foot and ACL injuries is also the subject of U.S. Pat. No. 5,107,608 to Kreitenberg and U.S. Pat. No. 6,131,313 to Pierce et al. Each of these solutions generally involves releasing the rear cuff from the front cuff, allowing increased rearward motion of the skier's lower leg relative to the ski in order to reduce the load on the knee. While this type of safety feature is a significant improvement over conventional ski boots, further improvements are still desired to provide greater safety and comfort to skiers.

In addition to safety, comfort and performance are also of great interest to downhill skiers, particularly those who ski competitively. Commonly-owned U.S. Pat. Nos. 4,880,251, 5,020,822, 5,026,087, and 5,412,883 offer significant improvements in both comfort and performance, including a flexible toe that makes walking considerably easier and safer, and the ability to adjustably cant the boot relative to its binding (and therefore the ski). As with the issue of safety, further improvements in comfort and performance are also continuously sought by the skiing industry.

SUMMARY OF INVENTION

The present invention provides ski equipment that provides, preferably in combination, a toe release system for reducing the risk of knee injuries and a steering system for increasing turning performance. These capabilities are preferably, though not necessarily, incorporated into a ski boot and binding system in which the boot comprises a foot shell with front and rear cuffs attached thereto in a rigid clam shell-type construction, and in which the binding secures the boot with a toe binding portion that engages a toe portion of the boot and with a rear binding portion that engages a heel portion of the boot.

In the toe release system of this invention, the toe binding portion of the binding is secured with a securing element at a position forward of the rear binding portion, and a releasing element communicates with the securing element for releasing the toe binding portion to permit movement of the toe binding portion relative to the rear binding portion. The toe release system further includes an element for moving the toe binding portion in a forward direction away from the rear binding portion when released by the releasing element, thereby releasing the toe portion of the boot and allowing the toe portion to lift upward away from the toe binding portion, even if the heel portion of the boot remains engaged with the rear binding portion. In a preferred embodiment, the releasing member is operated in response to the application of pressure to the rear cuff of the boot, such as when the skier is off-balance rearward, with hips below the knees in a squatting position, such that the skier's thigh applies forward pressure to the rear cuff or a portion thereof. As such, the toe release system is well adapted to release the boot of a skier from its bindings when the skier is in a situation where a phantom foot injury is very likely to occur.

The steering system of this invention is configured to provide lateral movement or "flexing" of the boot relative to the binding when the skier applies pressure with both forward and lateral components (force vectors) to the front cuff. As such, the steering system is able to increase the inside turn ski edge angle simply by applying the appropriate forward pressure while turning the skis, and provides a skier with more edge holding force in a steep racing-type turn because the skier's weight is more on top of the skis. In accordance with a preferred aspect o the invention, the steering system comprises a tracking assembly located between the front cuff and the foot shell of the boot. A particular tracking assembly comprises a follower engaged with a track member having at least two tracks that diverge from each other in the lateral directions of the boot. In this configuration, the follower can be caused to track along a first of the tracks by applying pressure on the front cuff in a direction having both a forward direction component (vector) and a component (vector) in a first lateral direction of the boot, which causes the boot to flex relative to the binding in the first lateral direction. Likewise, the follower tracks along a second of the tracks by applying pressure on the front cuff in a direction having both a forward direction component and a component in the second lateral direction of the boot (opposite the first), which causes the boot to flex relative to the binding in the second lateral direction.

In view of the above, it can be seen that the present invention offers significant improvements over conventional ski boots in terms of greater safety with respect to knee injuries, as well as improved performance characteristics. Other objects and advantages of this invention will be better appreciated from the following detailed description.

DETAILED DESCRIPTION

Figure 3:
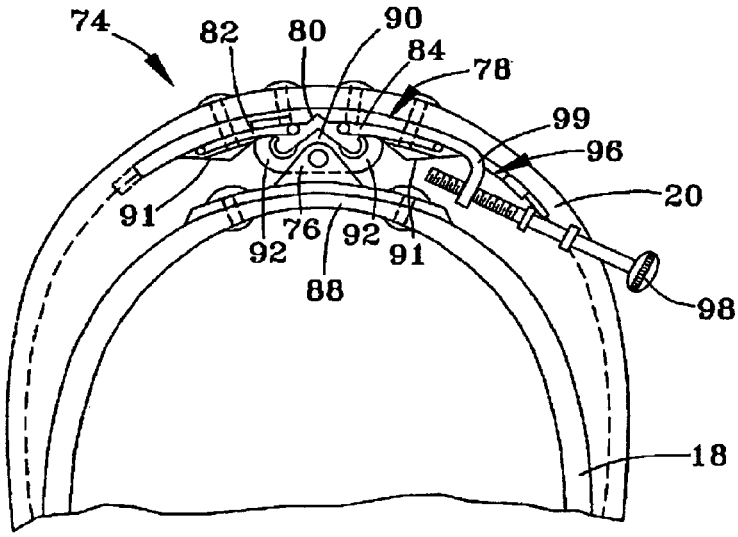
Figure 4:
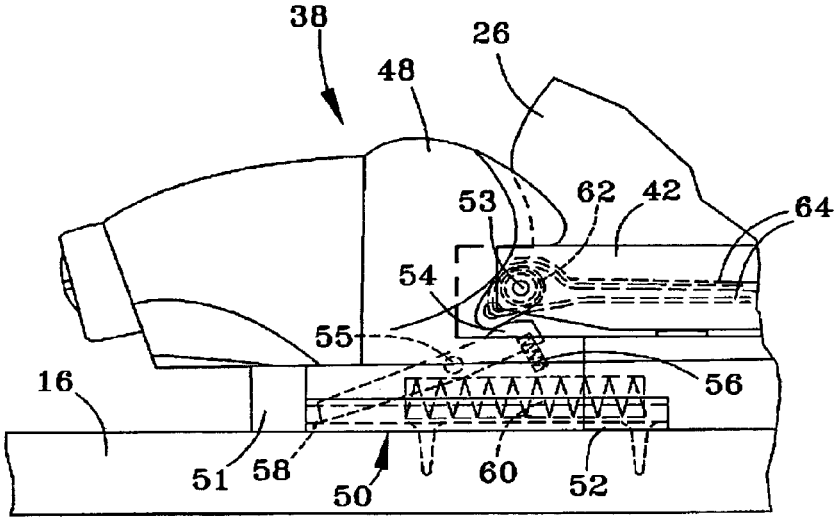
FIG. 4 is a cross-sectional side view of a toe-release system of the boot shown in FIG. 1.
Figure 5:
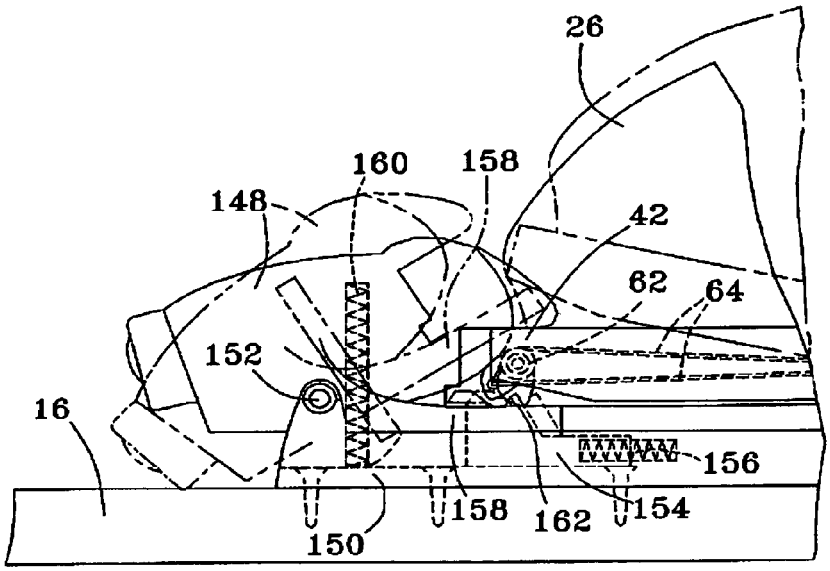
FIG. 5 is a cross-sectional side view of a toe-release system in accordance with an alternative embodiment of the invention.
Figure 6:
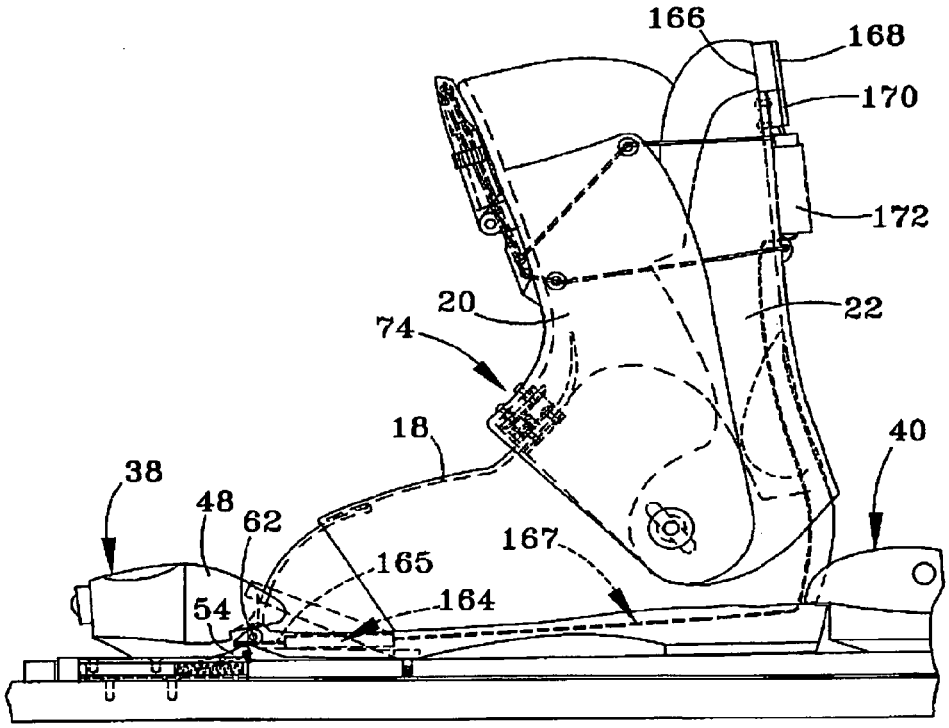
FIG. 6 is a cross-sectional side view of a boot equipped with a toe-release system in accordance with another alternative embodiment of the invention.

A ski boot and binding assembly 10 in accordance with a first embodiment of the invention is Illustrated in FIGS. 1 through 4, with alternative embodiments of the invention being illustrated in FIGS. 5 and 6. As will become apparent from the following discussion, the embodiments are depicted as combining two features of this invention—a toe release system and a steering system—though each of these features could be utilized separately from the other.

Figure 1:
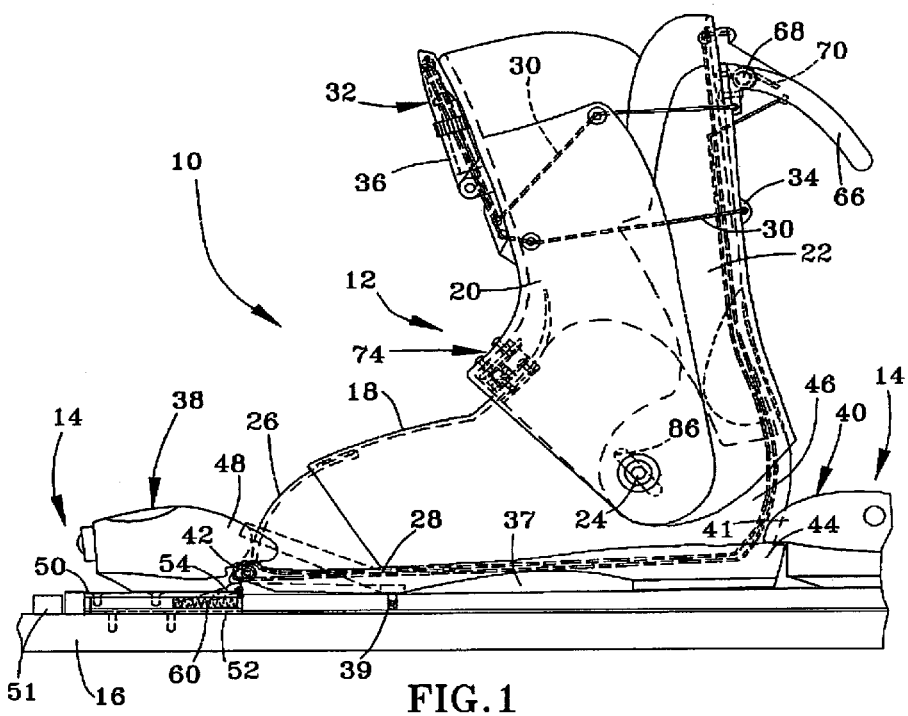
FIG. 1 is a side view showing in partial section a ski boot and binding system in accordance with an embodiment of this invention.

With reference to FIGS. 1 through 4, the ski boot and binding assembly 10 comprises a ski boot 12 mounted to a binding assembly 14, the latter of which is secured to a ski 16. The boot 12 is represented as being of the clam shell-type, and as such has a foot shell 18 and front and rear cuffs 20 and 22. The cuffs 20 and 22 are pivotably attached to each other and to the foot shell 18 at two pivot points defined by hinges 24 located on opposite sides of the boot 12. The rearward edge of the front cuff 20 overlies the rear cuff 22, with the portion of the rear cuff 22 beneath the front cuff 20 being shown in phantom in FIG. 1. The foot shell 18 includes a toe segment 26 that extends from and is overlapped by the shell 18. The toe segment 26 is illustrated in FIG. 1 as being connected to the shell 18 at a living hinge 28 located in the sole of the boot 12 at approximately the location where the ball of the foot is positioned when the boot 12 is worn. In accordance with commonly-owned U.S. Pat. Nos. 4,880,251, 5,020,822, 5,026,087 and 5,412,883, the hinge 28 aids the wearer while walking in the boot 12 by providing a focal point at the ball of the foot instead of the toe of the boot, as is the case with conventional ski boots having rigid soles. Other aspects of the toe segment 26 can be found in U.S. Pat. Nos. 4,880,251, 5,020,822, 5,026,087 and 5,412,883, whose contents are incorporated herein by reference.

The cuffs 20 and 22 are shown as being joined by cables 30 on opposite sides thereof, one of which is visible in FIG. 1. The cables 30 are anchored at their front and rear extremes by a front cuff release 32 located on the front cuff 20 and a hub 34 mounted on the rear cuff 22. The release 32 permits the boot 12 to be secured around the wearer's lower leg simply by pivoting a lever 36 downward. The release 32 also preferably enables the lengths of the cables 30 to be adjusted to provide a comfortable, secure fit to the lower leg. Other aspects regarding the manner in which the cables 30, release 32, and hub 34 can be constructed to secure the front and rear cuffs 20 and 22 are discussed in commonly-owned U.S. Pat. No. 5,412,883, and therefore will not be discussed in any detail here. Of significance is that the hub 34 is not required to have a safety-release feature described in U.S. Pat. No. 5,412,883, because the rear cuff 22 is not intended to be released from the front cuff 20 under conditions in which a rearward force is applied to the rear cuff 22. Instead, the toe-release system mentioned above (and discussed in detail below) addresses this concern. However, in combination with or in the absence of the toe-release system of this invention, the boot 12 can incorporate the cable, release and hub system disclosed in U.S. Pat. No. 5,412,883, such that a sufficiently large rearward force on the rear cuff 22 causes the rear cuff 22 to be released from the front cuff 20 in order to reduce the risk of knee injury. Alternatively, the boot 12 could be modified to employ other rear cuff release systems in combination with or in the absence of the toe-release system of this invention.

The binding 14 is represented as comprising front and rear binding units 38 and 40 for engaging the forward-most and rearward-most edges 42 and 44 of the boot sole (near the toe segment 26 and the boot heel 46, respectively), by which the boot 12 is secured to the binding 14. The edges 42 and 44 are shown as integral portions of the sole of the boot 12, though other constructions are foreseeable. The binding 14 is configured to be a "step-in" type binding, in which a skier enters the binding 14 by first inserting the forward edge 42 of the boot 12 beneath a toe-piece binding 48 of the front binding unit 38, and then steps down on the rear binding unit 40 to cause a rear binding 41 to engage the rearward edge 44 of the boot 12. The front and rear binding units 38 and 40 are both shown as being directly secured to the ski 16. A smooth hard metal plate 37 is preferably mounted between the binding units 38 and 40 and rides on adjustable ball bearings 39 that eliminate lateral and forward friction that would resist release of the boot 12 from the binding 14. The rear binding unit 40 can be of essentially any suitable design, and therefore will not be discussed in any detail here. In contrast, the front binding unit 38 shown in FIGS. 1 and 4 is adapted to release the toe segment 26 of the boot 12 under conditions where a knee injury, and particularly a phantom foot injury, is likely to occur.

The front binding unit 38 includes the previously-noted toe-piece binding 48, which has a base 50 slidably mounted to a track 52 secured to the ski 16. As more readily seen in FIG. 4, the base 50 has a latch 54 pivotably mounted thereto about a shaft 55 that is transverse to the longitudinal direction of the ski 16. The latch 54 is equipped with a spring 56 that biases the forward end of the latch 54 downward into engagement with a catch (e.g., groove) 58 in the track 52. One or more springs 60 bias the base 50 in the forward direction relative to the track 52, and therefore away from the rear binding unit 40. However, the force applied to the latch 54 by the spring 56 is sufficient to prevent release and movement of the base 50 and its toe-piece binding 48 unless the forward end of the latch 54 is disengaged from its catch 58. For this purpose, the forward edge 42 of the boot 12 is equipped with a device for actuating the latch 54, causing the rearward end of the latch 54 to move downward so that the forward end of the latch 54 rotates up and out of engagement with the catch 58. In the embodiment of FIGS. 1 and 4, the device for disengaging the latch 54 is represented as a cam 62 that, when rotated in a counterclockwise direction (as viewed in FIG. 4) about its axis 63, depresses the rearward end of the latch 54. The resulting clockwise rotation of the latch 54 (as viewed in FIG. 4) disengages the latch 54 from the catch 58, permitting the spring 60 to urge the toe-piece binding 48 to rapidly translate forward and out of engagement with the edge 42 of the boot 12 (as shown in phantom in FIG. 4). The distance the toe-piece binding 48 must travel to disengage the boot edge 42 will depend on the size and shape of the edge 42, with a distance of about one-half inch (about one centimeter) being sufficient for many applications. The distance that the toe-piece binding 48 is permitted to travel forward is shown in FIGS. 1 and 4 as being positively limited by a stop block 51.

In the embodiment of FIGS. 1 and 4, the cam 62 is caused to rotate through a cable 64 that is routed through the sole of the boot 12 to a paddle 66 mounted with a pivot attachment 68 to the rear cuff 22 of the boot 12. The cable 64 comprises upper and lower portions that can be part of a continuous cable or formed by separate cables attached to the cam 62, so that retracting the lower portion causes the cam 62 to rotate counterclockwise, resulting in actuation of the latch 54 and release of the toe-piece binding 48. As evident from FIG. 1, the lower portion of the cable 64 is attached to a portion of the paddle 66 above its pivot attachment 68, so that the lower portion of the cable 64 is retracted rearward when the paddle 66 is rotated forward (clockwise as viewed in FIG. 1) toward the rear cuff 22. The paddle 66 is mounted to the pivot attachment 68 with a torque spring 70 that acts to rotate the paddle 66 rearward away from the rear cuff 22 (counterclockwise as viewed in FIG. 1) about its pivot attachment 68. The upper portion of the cable 64 is attached to a portion of the paddle 66 below its pivot attachment 68, so that rearward movement of the paddle 66 causes the upper portion of the cable 64 to refract rearward, which in turn causes the cam 62 to rotate clockwise and return to its original position, such that the latch 54 is also permitted to return to its original position under the influence of the spring 56.

The above-described operation of the paddle 66 is able to reduce the risk of phantom foot injury under a condition that is likely to proceed such an injury, namely, when the skier's weight is rearward and his/her hips are below the knees, placing the skier's thigh against the rear cuff 22. With the skier in this position, the paddle 66 is depressed (rotated forward) by the skier's thigh, causing the cam 62 to disengage the latch 54 and permit the toe-piece binding 48 to shift forward and release the boot edge 42. Once the edge 42 is clear of the binding 48, the toe segment 26 of the boot 12 is able to rotate upward and/or laterally away from the ski 16, thus completely eliminating the forward force on the lower leg applied by the ski tail through the rigid structure comprising the ski 16 and rear cuff 22.

While a particular configuration and construction are represented in FIGS. 1 and 4 for causing the latch 54 to release the toe-piece binding 48, various other configurations are foreseeable and within the scope of this invention. As an example, FIG. 6 shows the cable 64 and paddle 66 being replaced by a solenoid 164 connected to the cam 62 with a rod 165 and electrically connected with an electrical wire 167 to one or more pressure sensors 166 mounted in the rear cuff 22. The solenoid 164 (or another suitable electromechanical device) is adapted to maintain the cam 62 in its initial fully-clockwise position under normal conditions while the boot 12 is worn, but to rotate the cam 62 counterclockwise when a sufficiently large pressure (force) is sensed by the pressure sensor (s) 166. This embodiment of the invention further comprises a microprocessor 168 that enables the skier to adjust the load at which the solenoid 164 is commanded to actuate the cam 62, a switch 170 that delivers the energizing signal to the solenoid 164, and a battery pack 172 for powering the solenoid 164, pressure sensor(s) 166 and microprocessor 168.

It is also within the scope of this invention to employ toe-piece bindings that release the toe segment 26 of the boot 12 by other than a sliding operation. For example, FIG. 5 represents a toe-piece binding 148 that is mounted to a base 150 for forward rotation about a pivot 152, instead of being mounted to a base (e.g., 50) that slides forward on a track (e.g., 52). As with the embodiment of FIGS. 1 and 4, the toe-piece binding 148 engages the forward edge 42 of the boot 12 to secure the toe segment 26 to the ski 16, and the base 150 is equipped with a latch 154 and spring 156. However, the latch 154 is mounted for translational movement on the base 150 and, when in a forward position under the force of the spring 156, engages a catch (e.g., edge) 158 of the toe-piece binding 148 to prevent forward (counterclockwise) rotation of the binding 148. One or more springs 160 bias the toe-piece binding 148 in the forward rotational direction. However, the latch 154 is sufficient to prevent release and movement of the toe-piece binding 148 unless the forward end of the latch 154 is disengaged from the catch 158 of the toe-piece binding 148. As with the previous embodiment, the cam 62 is adapted to actuate the latch 154, in this case rearwardly, to cause the forward end of the latch 154 to disengagement the catch 158 on the toe-piece binding 148. In FIG. 5, the cam 62 is shown as actuating the latch 154 by engaging a recess 162 in the upper surface of the latch 154. Once the latch 154 has disengaged the catch 158, the spring 160 urges the toe-piece binding 148 upward and out of engagement with the edge 42 of the boot 12 (as shown in phantom in FIG. 5).

Figure 2:
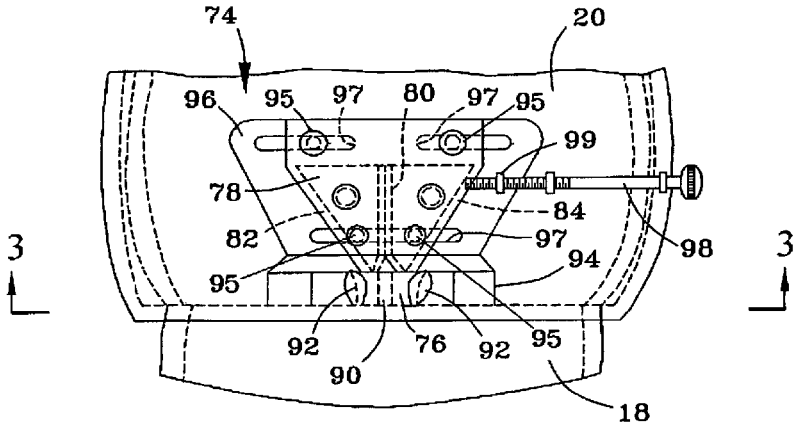
FIGS. 2 and 3 are plan and front cross-sectional views, respectively, of a steering system of the boot shown in FIG. 1.

FIGS. 1, 2, 3 and 6 depict the steering system of this invention, which can be used in combination or separately from the toe-release system described above. With particular reference to FIGS. 2 and 3, a steering unit 74 is represented as being between the foot shell 18 and the front cuff 20 of the boot 12. The steering unit 74 is operable to flex the boot 12 relative to the binding 14 when pressure with both forward and lateral components (force vectors) is applied to the front cuff 20. More particularly, the steering unit 74 enables the front and rear cuffs 20 and 22 to move or flex in unison relative to the foot shell 18, with flexing focused at a location approximately coinciding with the skier's ankles. Contrary to the limited rotational movement typically permitted between a front cuff and foot shell of a conventional clam-type ski boot, the boot 12 of this invention is adapted to permit lateral movement and twisting of the front cuff 20 (as well as the rear cuff 22 coupled to the front cuff 20 with the cable 30) relative to the foot shell 18 as a result of each hinge 24 being adapted to ride in a slot 86 formed in the foot shell 18, as depicted in FIG. 1.

The steering unit 74 is represented in the Figures as providing controlled flexing of the cuffs 20 and 22 relative to the foot shell 18 through the cooperation of a toggle-type follower 76 facing a track plate 78. The track plate 78 comprises at least two and preferably three diverging tracks 80, 82 and 84 that the follower 76 cams against when the front cuff 20 is forced forward relative to the foot shell 18 (as viewed in FIG. 1). In FIGS. 2 and 3, the follower 76 is shown as being roughly W-shaped and pivotably mounted to a plate 88, which in turn is mounted to the upper surface of the foot shell 18. The follower 76 has a central peak 90 and oppositely-disposed flanges 92, each of which engages one of the tracks 80, 82 and 84, depending on the direction of pressure applied by the skier on the front cuff 20. As evident from FIG. 2, the track plate 78 has a "neutral" zone 94 in which the follower 76 is not engaged with any of the tracks 80, 82 and 84, corresponding to the absence of a forward pressure on the front cuff 20. While the follower 76 is within the neutral zone of the track plate 78 (as shown in FIG. 3), the front cuff 20 (to which the track plate 78 is attached) is able to move laterally to the left and right relative to the foot shell 18 (to which the follower 76 is attached) and as a result, because the ski 16 is fixed to the foot shell 18 through the binding assembly 14, ski edge pressure is released by several degrees left or right, helping to prevent knee ligament strain or tear injuries if the skier has lost control of the skis. If only forward pressure is applied to the front cuff 20 (i.e., absent any significant lateral component to the pressure applied to the front cuff 20), the peak 90 of the follower 76 engages and follows the center track 80, which is in the form of a V-shaped groove that is complementary in shape to the peak 90. Under this circumstance, the front and rear cuffs 20 and 22 flex as a unit relative to the foot shell 18 in a forward direction.

If a sufficient amount of lateral pressure is applied (i.e., a sufficient lateral component is present in the forward pressure applied to the front cuff 20), the follower 76 moves in the direction of the lateral component, causing the upper edge of the flange 92 on the side to which pressure is applied to cam up against a slope 91 adjacent the flange 92. For example, if the pressure on the front cuff 20 includes a lateral component to the left as viewed in FIGS. 2 and 3, the upper edge of the lefthand flange 92 cams against the lefthand slope 91, causing the follower 76 to rotate counterclockwise. With sufficient forward pressure, the follower 76 moves forward to engage its righthand flange 92 with the lefthand track 82, which diverges to the left from the center and righthand tracks 80 and 84. In contrast to the center track 80, the lefthand and righthand tracks 82 and 84 are defined by the raised portions or edges of the track plate 78, preferably shaped to have circular cross-sections that are complementary in shape to the interior contours of the righthand and lefthand flanges 92, respectively. As the righthand flange 92 follows the lefthand track in FIGS. 2 and 3, the boot 12 is caused to flex forward and leftward (i.e., a direction having both forward and leftward components) relative to the foot shell 18, corresponding in direction to the lefthand track 82 being tracked by the follower 76. From the above, one can appreciate that if the pressure on the front cuff 20 were to include a rightward lateral component as viewed in FIGS. 2 and 3, the upper edge of the righthand flange 92 would cam against the righthand slope 91, causing the follower 76 to rotate clockwise so that the lefthand flange 92 can engage the righthand track 84 to cause the boot 12 to flex forward and rightward relative to the foot shell 18.

As represented in FIGS. 2 and 3, the steering unit 74 of this invention can be adapted to permit the track plate 78 to be adjusted in the lateral directions, effectively canting the upper portion of the boot 12 relative to the foot shell 18, binding 14 and ski 16. For this purpose, the track plate 78 is shown mounted with fasteners 95 to a track base 96, which is fixedly attached to the front cuff 20. Lateral slots 97 defined in the track plate 78 (FIG. 2) receive the fasteners 95, and an adjustment screw 98 mounted to the track base 96 is threadably engaged with a flange 99 on the track plate 78, so that rotation of the adjustment screw 98 causes the track plate 78 to be selectively and controllably translated in a lateral direction, depending on the direction of screw rotation.

In practice, flex angles of as much as fifteen degrees have been readily attainable with the steering unit 74 depicted in FIGS. 2 and 3. While the follower 76 and track plate 78 are depicted as being mounted to the foot shell 18 and front cuff 20, respectively, their positions could be reversed. Furthermore, while a particular type of follower 76 and track plate 78 is shown, various other configurations for these components could be used yet still achieve the operation of the steering unit 74, which is fundamentally to enable a skier to selectively cause the front cuff 20 to move in a lateral direction relative to the foot shell 18 by applying a forward pressure on the front cuff 20 with a lateral component in the direction the skier wants his or her boot to turn. The effect is to increase the inside turn ski edge angle, which provides the skier with more edge holding force in a steep turn because the skier's weight is more on top of the ski 16.

While not discussed above, the ski boot and binding assemblies of this invention can be modified to further include conventional or otherwise known equipment for skis, boots and bindings. For example, the binding 14 can be equipped with a ski brake to inhibit the ski from traveling downhill after being released from the boot 12 by the front and rear binding assemblies 38 and 40. Furthermore, the binding 14 is adapted to allow a skier to release the boot 12 when desired, such as by physically depressing a rearward extension of the rear binding assembly 40 on which a ski pole tip cup (not shown) is provided in accordance with conventional practice. Finally, various equivalents could be used in combination with or in lieu of the disclosed mechanical and electrical devices, e.g., the disclosed springs, levers, cams, tracks, cables, solenoids, etc. Accordingly, while the invention has been described in terms of particular embodiments, it is apparent that other forms could be adopted by one skilled in the art. Therefore, the scope of the invention is to be limited only by the following claims.

What is claimed is:

1. Ski equipment comprising:

a boot comprising a foot shell having toe and heel portions, and front and rear cuff portions attached to the foot shell;

a binding comprising a toe binding portion and a rear binding portion, the toe binding portion engaging the toe portion of the boot and the rear binding portion engaging the heel portion of the boot so as to secure the boot to the binding;

means for securing the toe binding portion at a forward position relative to the rear binding portion;

means in communication with the securing means for releasing the toe binding portion to permit movement of the toe binding portion relative to the rear binding portion; and means for moving the toe binding portion in a forward direction away from the rear binding portion when released by the releasing means so as to release the toe portion of the boot and allow the toe portion to lift upward away from the toe binding portion though the heel portion of the boot remains engaged with the rear binding portion.

2. The ski equipment according to claim 1, wherein the releasing means is mounted to the rear cuff portion.

3. The ski equipment according to claim 1, wherein the releasing means disengages the securing means.

4. The ski equipment according to claim 1, wherein the releasing means releases the toe binding portion in response to forward pressure on at least a portion of the rear cuff portion.

5. The ski equipment according to claim 1, wherein the front and rear cuff portions are pivotably attached to the foot shell.

6. The ski equipment according to claim 5, further comprising means for releasably securing the rear cuff portion to the front cuff portion, wherein the releasably securing means does not release the rear cuff portion from the front cuff portion in response to rearward pressure on the rear cuff portion.

7. The ski equipment according to claim 1, wherein the releasing means releases the toe binding portion in response to forward pressure on at least a portion of the rear cuff portion, the ski equipment further comprises means for releasably securing the rear cuff portion to the front cuff portion, and the releasably securing means does not release the rear cuff portion from the front cuff portion in response to the forward pressure on the rear cuff portion.

8. The ski equipment according to claim 1, wherein the releasing means comprises a lever pivotably mounted to the rear cuff portion.

9. The ski equipment according to claim 8, wherein the lever is oriented so that forward pressure applied to the lever will cause the lever to pivot forward.

10. The ski equipment according to claim 8, wherein the releasing means further comprises a cable routed from the rear cuff portion to the securing means.

11. The ski equipment according to claim 10, wherein the securing means comprises a latch mounted to the toe binding portion and biased for engagement with the binding so as to prevent movement of the toe binding portion relative to the rear binding portion, the releasing means further comprises a camming member mounted to the toe portion of the boot, and the cable is operative to actuate the camming member into engagement with the latch so as to disengage the latch in response to pivoting of the lever.

12. The ski equipment according to claim 1, wherein the releasing means comprises an electronic pressure sensor mounted to the rear cuff portion.

13. The ski equipment according to claim 12, wherein the pressure sensor is located on the rear cuff portion so that forward pressure applied to the rear cuff portion is sensed by the pressure sensor.

14. The ski equipment according to claim 12, wherein the securing means comprises a latch mounted to the toe binding portion and biased for engagement with the binding so as to prevent movement of the toe binding portion relative to the binding, the releasing means further comprises a camming member mounted to the toe portion of the boot and an electronic means for actuating the camming member into engagement with the latch so as to disengage the latch from the binding in response to pressure applied to the pressure sensor.

15. The ski equipment according to claim 1, wherein the moving means causes the toe binding portion to slide in the forward direction away from the rear binding portion when released by the releasing means.

16. The ski equipment according to claim 1, wherein the moving means causes the toe binding portion to rotate in the forward direction away from the rear binding portion when released by the releasing means.

17. The ski equipment according to claim 1,further comprising guide means for causing the front cuff portion to rotate relative to the foot shell in one of at least two directions having both forward and lateral components when forward and lateral pressure is applied to the front cuff portion.

18. The ski equipment according to claim 17, wherein the guide means comprises a tracking assembly located between the front cuff portion and the foot shell, the tracking assembly comprising a follower engaged with a track member that comprises at least first and second tracks that diverge from each other in oppositely-disposed first and second lateral directions, wherein the follower is caused to track along the first track by applying pressure on the front cuff portion in a direction having both a forward direction component and a component in the first lateral direction and causes the front cuff portion to move relative to the foot shell in the first lateral direction, and wherein the follower is caused to track along the second track by applying pressure on the front cuff portion in a direction having both a forward direction component and a component in the second lateral direction and causes the front cuff portion to move relative to the foot shell in the second lateral direction.

19. The ski equipment according to claim 18, wherein the track member is adjustably mounted to one of the front cuff portion and foot shell.

20. The ski equipment according to claim 19, wherein the guide means further comprises means for causing the track member to move in the first and second lateral directions.

21. Ski equipment comprising:

a boot comprising a foot shell having toe and heel portions, and front and rear cuffs pivotably attached to the foot shell;

means for releasably securing the rear cuff to the front cuff;

a binding comprising a toe binding portion and a rear binding portion, the toe binding portion engaging the toe portion of the boot and the rear binding portion engaging the heel portion of the boot so as to secure the boot to the binding;

a latch adapted to secure the toe binding portion at a forward position relative to the rear binding portion;

a release member mounted to the rear cuff and in communication with the latch for releasing the latch to permit forward movement of the toe binding portion relative to the rear binding portion; and means for moving the toe binding portion in a forward direction away from the rear binding portion when the latch is released so as to release the toe portion of the boot from the toe binding portion and allow the toe portion to lift upward away from the toe binding portion while the heel portion of the boot remains engaged with the rear binding portion.

22. The ski equipment according to claim 21, wherein the release member causes the latch to release the toe binding portion in response to forward pressure applied to the release member.

23. The ski equipment according to claim 22, wherein the release member comprises a lever pivotably mounted to the rear cuff.

24. The ski equipment according to claim 21, further comprising a cable for providing communication between the release member and the latch, a camming member mounted to the toe portion of the boot, the cable being attached to the camming member and operative to actuate the camming member into engagement with the latch so as to release the latch and permit forward movement of the toe binding portion.

25. Ski equipment comprising:

a boot comprising a foot shell having toe and heel portions, a front cuff attached to the foot shell, and a rear cuff attached to the foot shell;

guide means for causing the front cuff to rotate relative to the foot shell in one of at least three forward directions when pressure having at least a forward component is applied to the front cuff, at least two of the at least three directions having both forward and lateral components, the guide means causing the front cuff to rotate relative to the foot shell in one of the at least two directions when the pressure applied to the front cuff has both forward and lateral components;

a binding comprising a toe binding portion and a rear binding portion, the toe binding portion engaging the toe portion of the boot and the rear binding portion engaging the heel portion of the boot so as to secure the boot to the binding;

means for securing the toe binding portion at a forward position relative to the rear binding portion;

means in communication with the securing means for releasing the toe binding portion to permit movement of the toe binding portion relative to the rear binding portion; and means for moving the toe binding portion in a forward direction away from the rear binding portion when released by the releasing means so as to release the toe portion of the boot and allow the toe portion to lift upward away from the toe binding portion though the heel portion of the boot remains engaged with the rear binding portion.

26. The ski equipment according to claim 25, wherein the releasing means is mounted to the rear cuff.

27. The ski equipment according to claim 25, wherein the releasing means releases the toe binding portion in response to forward pressure on at least a portion of the rear cuff.

28. The ski equipment according to claim 27, wherein the releasing means comprises a lever pivotably mounted to the rear cuff.

29. The ski equipment according to claim 28, wherein the lever is oriented so that forward pressure applied to the lever will cause the lever to pivot forward.

30. The ski equipment according to claim 29, wherein the securing means comprises a latch mounted to the toe binding portion and biased for engagement with the binding so as to prevent movement of the toe binding portion relative to the rear binding portion, the releasing means further comprises a camming member mounted to the toe portion of the boot and operative to actuate the camming member into engagement with the latch so as to disengage the latch in response to pivoting of the lever.

* * * * *